US011083305B2

(12) United States Patent
Baranoff

(10) Patent No.: US 11,083,305 B2
(45) Date of Patent: Aug. 10, 2021

(54) METHOD OF SECURING A VERTICAL AIR CHAMBER TO A HORIZONTAL PLATFORM

(71) Applicant: Sergei Constantine Baranoff, West Sacramento, CA (US)

(72) Inventor: Sergei Constantine Baranoff, West Sacramento, CA (US)

( * ) Notice: Subject to any disclaimer, the term of this patent is extended or adjusted under 35 U.S.C. 154(b) by 371 days.

(21) Appl. No.: 16/022,565

(22) Filed: Jun. 28, 2018

(65) Prior Publication Data

US 2019/0000237 A1 Jan. 3, 2019

Related U.S. Application Data

(60) Provisional application No. 62/526,099, filed on Jun. 28, 2017.

(51) Int. Cl.

| | |
|---|---|
| ***A47C 19/02*** | (2006.01) |
| ***A47C 17/86*** | (2006.01) |
| ***A47C 21/00*** | (2006.01) |
| ***A47C 27/08*** | (2006.01) |

(52) U.S. Cl.

CPC ..... *A47C 19/022* (2013.01); *A47C 17/86* (2013.01); *A47C 21/00* (2013.01); *A47C 27/081* (2013.01)

(58) Field of Classification Search

CPC ..... A47C 19/04; A47C 19/00; A47C 19/022; A47C 19/028; A47C 19/22; A47C 20/048; A47C 21/00; A47C 21/026; A47C 27/00; A47C 27/08; A47C 27/085; A47C 27/087;

(Continued)

(56) References Cited

U.S. PATENT DOCUMENTS 5,075,910 A 12/1991 Morten
2003/0028972 A1 2/2003 Michaelis et al.

(Continued)

FOREIGN PATENT DOCUMENTS

GB 815663 A * 7/1959 ..... A47C 19/022

OTHER PUBLICATIONS

PCT International Search Report and Written Opinion, PCT Application No. PCT/US2018/040139, Sep. 2018, 17 Pages.

*Primary Examiner* — David R Hare
*Assistant Examiner* — Adam C Ortiz
(74) *Attorney, Agent, or Firm* — Fenwick & West LLP

(57) ABSTRACT

Embodiments of the invention provide a method of mounting an inflatable headboard assembly to a horizontal plane (e.g., a bed) without using a fixed mechanical fastening. The headboard assembly may assume various shapes, sizes, and/or styles while affording easy assembly and storage. The inflatable headboard assembly does not require permanent modification to its surrounding area. Rather, the inflatable headboard assembly is simply inflated to various heights that conform to the existing dimensions of the surrounding environment. The inflatable headboard assembly can be mounted to various locations of a bed without requiring additional equipment, and deflated for compact storage. The inflatable headboard assembly may include an inflatable footboard counterpart similar to the inflatable headboard assembly but smaller in scale. In addition, the inflatable headboard assembly may include lights for illuminating portions of the headboard, and/or visual markers for receiving augmented reality overlay.

20 Claims, 6 Drawing Sheets

(58) Field of Classification Search
CPC ..... A47C 27/10; A47C 17/86; A47C 27/081; A47C 7/0506
See application file for complete search history.

(56) References Cited

U.S. PATENT DOCUMENTS

| | | | | |
|---|---|---|---|---|
| 2006/0010606 | A1* | 1/2006 | Harris | A47D 15/003 5/706 |
| 2007/0199153 | A1 | 8/2007 | Wu | |
| 2007/0226900 | A1 | 10/2007 | Levinsohn | |
| 2015/0131263 | A1 | 5/2015 | Stork et al. | |
| 2016/0045033 | A1* | 2/2016 | Gioe | A47C 19/022 5/280 |

* cited by examiner

METHOD OF SECURING A VERTICAL AIR CHAMBER TO A HORIZONTAL PLATFORM

CROSS-REFERENCE TO RELATED APPLICATION

This application claims the benefit of U.S. Provisional Application No. 62/526,099 filed Jun. 28, 2017 which is hereby incorporated by reference in its entirety.

BACKGROUND

The present disclosure relates generally to a headboard assembly, and specifically to an inflatable headboard assembly for mounting to a horizontal platform such as a bed.

Presently bedding systems are typically fixed units comprised of a mattress, box springs, a headboard, and/or a footboard. Although these elements are modular by design, they are typically bulky and large, which can make them difficult to transport and cumbersome for shipping and storage. In addition, the elements comprising bedding systems are typically of fixed design or style, thus restricting owners to decorating themes within the area around the bedding system to that of the fixed design.

A standard practice for those purchasing bedding systems is to select a headboard of a certain style, and to design the surrounding environment similar to the style of the bedding system. For example, a bedding system owner may purchase additional furniture that mimics the style or theme of a headboard, or may attempt to alter the appearance of the headboard using paint and/or decals. Though some attempts have previously been made to allow for variation of bedding themes, no attempts have provided for a cost-effective solution while demonstrating space saving means. Accordingly, there is a need to provide a cost-effective method that allows bedding system owners to easily change the theme of a bedding system without requiring the purchase of additional bulky parts that are large and cumbersome to store.

SUMMARY

Embodiments of the invention provide an effective system of mounting an inflatable headboard assembly to a horizontal plane (e.g., a bed) without using a fixed mechanical fastening. Because the system is inflatable, the headboard assembly may assume various shapes, sizes, and/or styles while affording easy assembly and storage. In addition, the inflatable headboard assembly does not require any permanent modification to its surrounding area (e.g., screws or nails in a bedroom wall). Rather, the inflatable headboard assembly can simply be inflated to various heights that conform to the existing dimensions of the surrounding environment. Furthermore, the inflatable headboard assembly can be mounted to various locations of a bed without requiring additional equipment, and deflated for compact storage. The inflatable headboard assembly may include an inflatable footboard counterpart like the inflatable headboard assembly but smaller in scale. In addition, the inflatable headboard assembly may include lights for illuminating portions of the headboard, and/or visual markers for receiving augmented reality overlay when the visual markers are detected by a client device.

BRIEF DESCRIPTION OF THE DRAWINGS

The teachings of the embodiments can be readily understood by considering the following detailed description in conjunction with the accompanying drawings.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION OF THE DRAWINGS

Figure 1:
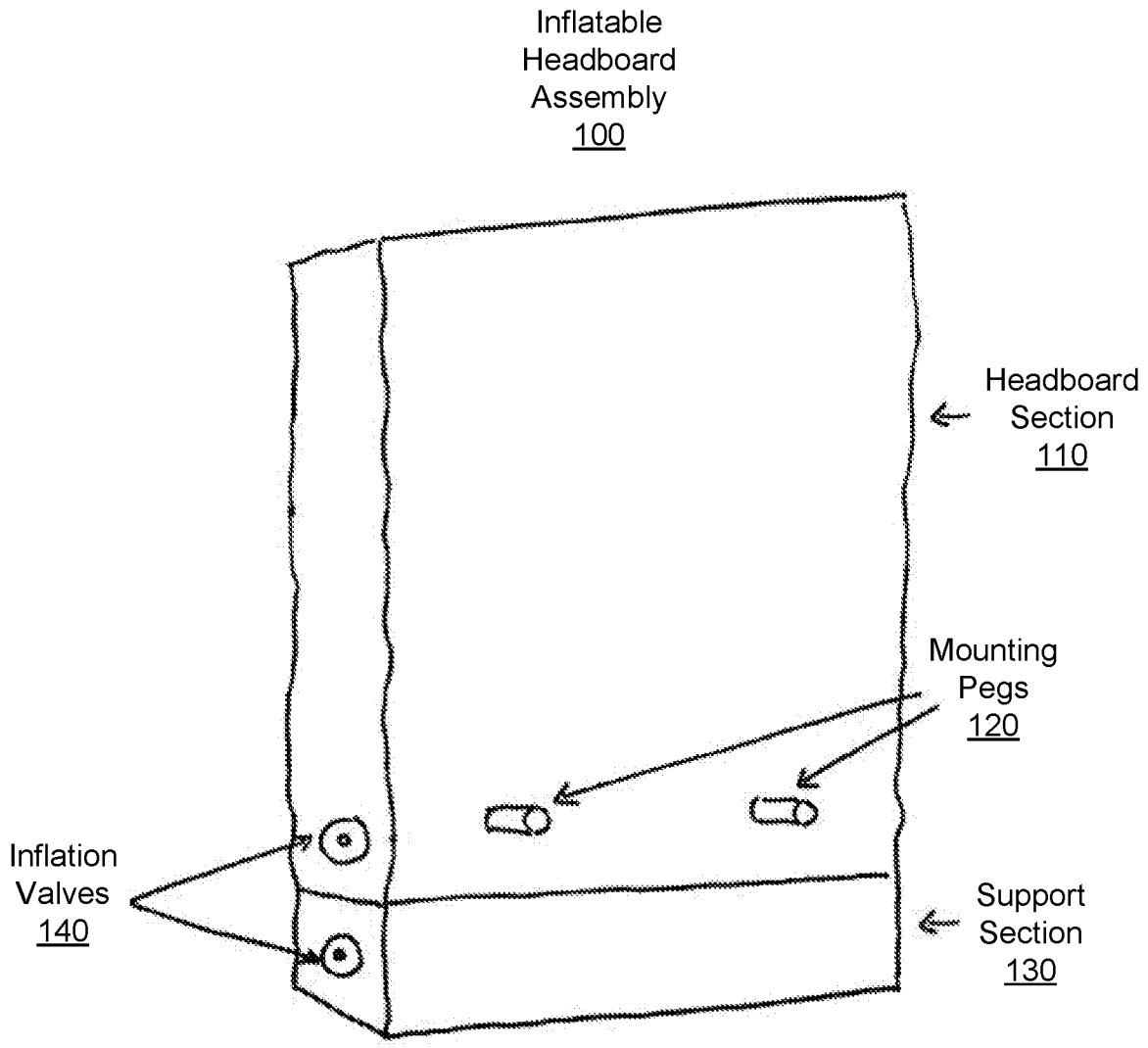
FIG. 1 is a perspective view of an inflatable headboard assembly with mounting pegs and inflation valves, in accordance with an embodiment.

FIG. 1 illustrates a perspective view of the inflatable headboard assembly 100, according to one embodiment. When the inflatable headboard assembly 100 is inflated, it may be used to provide a user with headboard functionality for a bed with or without an existing headboard. If the bed is already equipped with a headboard, the inflatable headboard assembly 100 may be mounted to the existing headboard using straps, for example. If the bed does not have an existing headboard, the inflatable headboard assembly 100 may be mounted to the bed using an attachment member. The inflatable headboard assembly may exhibit various sizes, shapes, colors, themes, and materials. In one embodiment, the inflatable headboard assembly 100 is composed of a non-toxic, odor-free material. In the embodiment illustrated in FIG. 1, the inflatable headboard assembly 100 includes a headboard section 110, mounting pegs 120, a support section 130, and inflation valves 140.

The headboard section 110 of the inflatable headboard assembly 100 is an inflatable bladder that provides headboard functionality when mounted to a horizontal surface, such as a bed. In the embodiment illustrated in FIG. 1, the headboard section 110 includes an inflation valve 140 used to receive air for inflating the inflatable bladder. The inflation valve 140 may receive air from a user physically blowing into the inflation valve 140 or via an air pump. In one embodiment, the inflation valve includes an adaptor used for establishing a connection between an air pump and the inflation valve 140. Once inflated, the headboard section 110 may receive additional attachments via the mounting pegs 120 located on its anterior surface. The headboard section 110 may be modeled in a variety of shapes, sizes, and/or themes. For example, the headboard section 110 may include graphics illustrating the front end of a firetruck while representing the color and shape similar to that of an actual firetruck. Additional embodiments are further described with respect to FIG. 4.

The support section 130 is an inflatable bladder (separate from the headboard section 110) that provides the inflatable headboard assembly 100 with support at its base, as well as the ability to adjust its height in relation to a bed upon which it is to be mounted. The support section 130 includes an inflation valve 140 used to receive air for inflating the inflatable bladder. Similar to the inflation valve 140 for the headboard section 110, the support section 130 inflation valve 140 may receive air directly from a user and/or from an air pump. As the support section 130 is inflated (e.g., filling the inflatable bladder), the headboard section 110 and mounting pegs 120 increase in height relative to the base of the support section 130. Conversely, as the support section is deflated (e.g., emptying the inflatable bladder), the headboard section 110 and mounting pegs 120 decrease in height relative to the base of the support section 130. Thus, the support section 130 allows the headboard section 110 and mounting pegs 120 to align properly with a bed, or other such horizontal surface, upon which the inflatable headboard assembly 100 is to be mounted.

Figure 2:
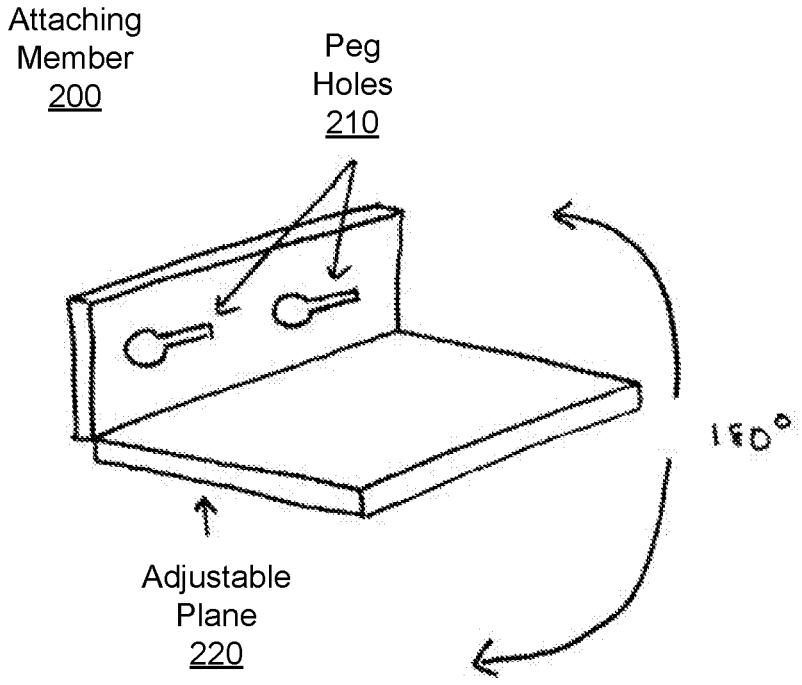
FIG. 2 is a perspective view of an attaching member including peg holes and an adjustable plane, in accordance with an embodiment.

FIG. 2 illustrates an attaching member 200, according to one embodiment. The attaching member 200 is used for mounting the inflatable headboard assembly 100 to a bed. When connected to the inflatable headboard assembly 100, the attaching member 200 is positioned relative to the headboard section 110 and support section 130 such that two sections extend orthogonally away from the attaching member 200 in opposite directions (e.g., extending toward the ceiling and toward the floor, respectively). In one embodiment, the attaching member 200 is located at the end of the headboard section 110 (i.e., where the headboard section 110 and support section 130 meet). In other embodiments, the attaching member 200 may be located higher or lower along the anterior surface, posterior surface, or any other surface of the inflatable headboard assembly 100. In one embodiment, the attaching member is composed of the same material as the inflatable headboard assembly 100, and exhibits the same theme and/or color. In the embodiment illustrated in FIG. 2, the attaching member includes peg holes 210 and an adjustable plane 220.

The peg holes 210 provide a means of connecting the attaching member 200 to the mounting pegs 120 on the headboard section 110 of the inflatable headboard assembly 100. In one embodiment, such as the embodiment illustrated in FIG. 2, the peg holes 210 may be contoured to receive a mounting peg 120 in a male-female coupling manner, where the mounting peg 120 includes a beveled head that enters a peg hole 210 and slides horizontally to lock the mounting peg 120 in place. In another embodiment, the peg holes 210 may be of other shapes or sizes than that shown in FIG. 2.

The adjustable plane 220 is a flat surface attached at the base of the attaching member 200 used for securing the attaching member 200 to the bed upon which the inflatable headboard assembly 100 is to be mounted. To properly secure the inflatable headboard assembly 100 to a bed, the adjustable plane 220 may be adjusted about its axis to adequately align with the cavity between a mattress and the underlying box spring set. This is illustrated in FIG. 2 where the adjustable plane 220 can swing an entire 180 degrees in relation to the surface of the attaching member 200. Once positioned, the adjustable plane 220 is wedged between the mattress and the underlying box spring set to secure the attaching member 200 in place. In one embodiment, the adjustable plane 220 is composed of a plastic, such as polyethylene terephthalate (PET). In other embodiments, the adjustable plane 220 may be composed of materials of various textures and/or rigidities, such as cardboard or fiberboard, for example.

Figure 3:
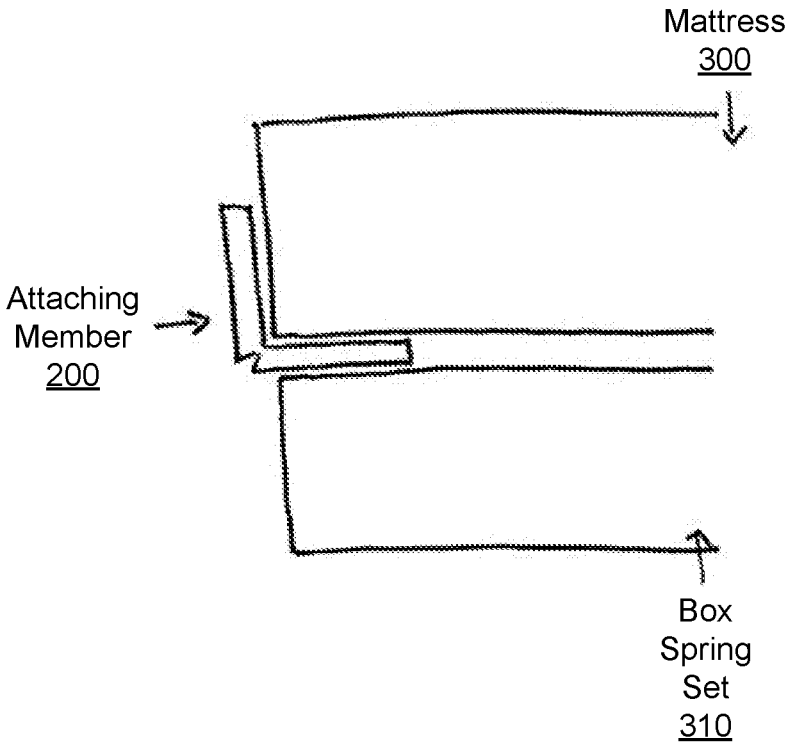
FIG. 3 is a side view of the attaching member positioned between a mattress and a box spring set, in accordance with an embodiment.

FIG. 3 illustrates an example process by which the adjustable plane 220 secures the attaching member 200 to a mattress upon which the inflatable headboard assembly 100 is to be mounted. In the example illustrated in FIG. 3, the adjustable plane 220 is wedged within the cavity between the mattress 300 and the box spring set 310. To secure the attaching member 200 to the mattress 300 in this manner, a user may first ensure that the adjustable plane 220 is properly aligned with the cavity between the mattress 300 and the box spring set 310. Once properly aligned, the user may slightly lift the edge of the mattress while laying the adjustable plane 220 on the surface of the box spring set 310. Once the adjustable plane 220 is in place, the user may lower the mattress 300 onto the box spring set 310, effectively wedging the adjustable plane 220 between the mattress 300 and the box spring set 310.

Figure 4:
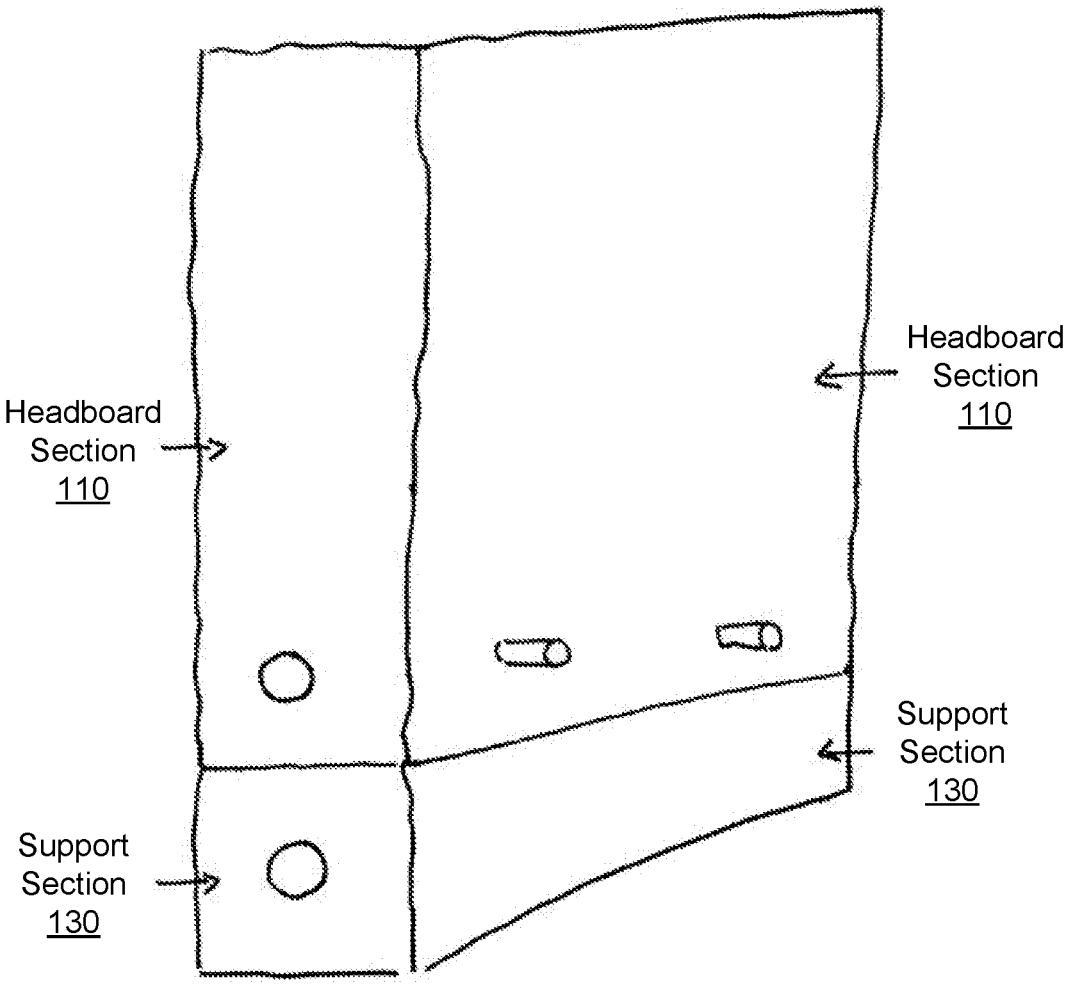
FIG. 4 is a perspective view of the inflatable headboard assembly comprised of a headboard section and support section, in accordance with an embodiment.

FIG. 4 is a perspective view illustrating an example headboard section 110 and support section 130. In the example shown in FIG. 4, the inflatable bladders comprising the headboard section 110 and support section 130 are separate from one another, and each inflation bladder includes its own inflation valve 120. This allows each inflatable bladder to be inflated independently. For example, the headboard section 110 may be fully inflated in order to provide the most support for a user while the support section 130 is only partially inflated to accommodate alignment between the mounting pegs 120 (and/or adjustable plane 220) and the cavity between the mattress and the box spring set. Similarly, the user may forgo inflating the support section 130 altogether to accommodate alignment with beds residing a shorter distance from the floor. In this way, the support section 130 may be inflated independently of the headboard section 110 to accommodate for height variations while maintaining the functionality of the headboard section 110.

In one embodiment, the headboard section 110 includes internal lights 240 for illuminating illustrated features on the surface of the headboard section 110. For example, a headboard section 110 having an appearance like a firetruck might include a series of lights positioned within the headboard section 110 that coincide with the positions of emergency lights used by an actual firetruck. In another embodiment, the headboard section 110 provides an interactive user experience through augmented reality technologies (e.g., computer vision and object recognition) that seamlessly interweave overlaid sensory information with the surrounding environment via client devices, such as smartphones and/or tablet computers. In this embodiment, the headboard section 110 may include one or more objects, such as pixels or other visual markers 250, that provide reference for positioning virtual objects for display when detected by a client device, such as an animated face that gives the firetruck the appearance of a living character, for example.

Figure 5:
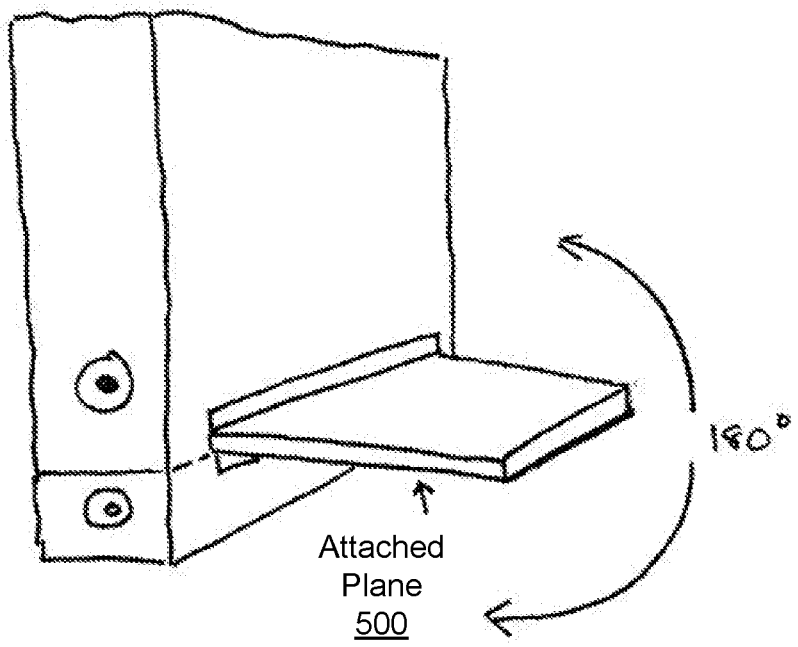
FIG. 5 is a perspective view of the inflatable headboard assembly with an attached plane, in accordance with an embodiment.

FIG. 5 illustrates an embodiment in which an attached plane 500 is coupled to the inflatable headboard assembly 100. The attached plane 500 is a flat surface attached to the inflatable headboard assembly 100 used for mounting the inflatable headboard assembly 100 to a bed. To accommodate a proper mounting angle, the attached plane 500 can rotate 180 degrees in relation to the surface of the inflatable headboard assembly 100, and may be made of a flexible material, such as plastic, to allow for bending and twisting motions. In this embodiment, the attached plane 500 is non-mechanically fastened to the inflatable headboard assembly 100, as opposed to the mechanical fastening between the attaching member 220 and the mounting pegs 120. For example, the attached plane 500 may be permanently affixed to the surface of the inflatable headboard assembly 100 via sonic/ultrasonic welding or any other industrial technique commonly used for plastics. However, the attached plane 500 may additionally be made of cardboard or any other suitable rigid material, and/or may be wrapped in the same material of which the inflatable headboard assembly 100 is composed.

Figure 6:
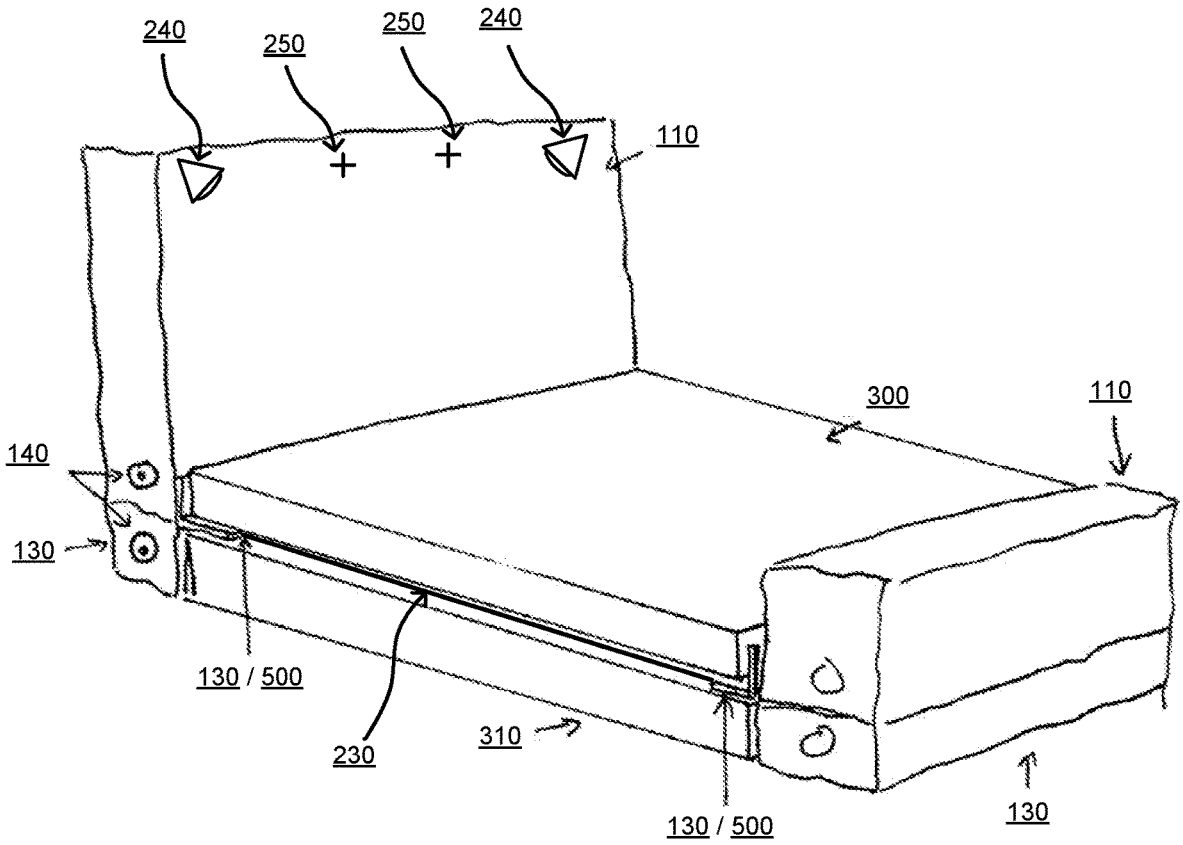
FIG. 6 is a perspective view of a bedding system including an inflatable headboard member, an inflatable footboard, and their respective attaching members, in accordance with an embodiment.

FIG. 6 is a perspective view of an example use case of the inflatable headboard assembly 100. In this example, the headboard section 110 and the support section 130 comprising the inflatable headboard assembly 100 are fully inflated via the inflation valves 140. In addition, the adjustable plane 220/attached plane 500 is wedged within the cavity between the mattress 300 and the box spring set 310, securing the inflatable headboard assembly 100 to the bed. Further, the example illustrated in FIG. 6 includes an inflatable footboard positioned at the foot of the bed that is similar in composition but smaller in scale to the inflatable headboard assembly 100. In one embodiment, the inflatable headboard assembly may be connected to the inflatable footboard by connecting their respective straps 230 underneath the mattress 300, or by any other unobtrusive means. In one embodiment, the inflatable footboard is comprised of a headboard section 110 and support section 130 having a smaller surface area than those of the inflatable headboard assembly 100. However, the fastening mechanisms (e.g., attaching member 200 and attached plane 500) may be similar both in appearance and function as those previously discussed. Additionally, the inflatable footboard shown in FIG. 6 may exhibit any of the attributes previously described with respect to the inflatable headboard assembly 100.

Additional Considerations

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but still co-operate or interact with each other.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the disclosure. This description should be read to include one or at least one and the singular also includes the plural unless it is obvious that it is meant otherwise.

Upon reading this disclosure, those of skill in the art will appreciate still additional alternative structural and functional designs for a system and a process for generating messaging directories and messaging members of those directories. Thus, while particular embodiments and applications have been illustrated and described, it is to be understood that the described subject matter is not limited to the precise construction and components disclosed herein and that various modifications, changes and variations which will be apparent to those skilled in the art may be made in the arrangement, operation and details of the method and apparatus disclosed herein.

What is claimed is:

1. An inflatable headboard assembly for mounting to a bed, the inflatable headboard assembly comprising:

an attaching member contoured to fit underneath a mattress;

a headboard section comprising a first inflatable bladder, the headboard section extending from the attaching member in a first direction orthogonal to the attaching member; and a support section comprising a second inflatable bladder, the support section extending from the attaching member in a second direction opposite the first direction, the attaching member between the headboard section and the support section, where inflating the second inflatable bladder increases a length of the support section in the second direction and deflating the second inflatable bladder decreases the length of the support section in the second direction.

2. The inflatable headboard assembly of claim 1, further comprising:

a set of mounting pegs affixed to an anterior surface of the inflatable headboard assembly, wherein the attaching member has a set of peg holes configured to couple the attaching member to the set of mounting pegs.

3. The inflatable headboard assembly of claim 2, wherein the set of peg holes are configured to couple with the set of mounting pegs in a male-female coupling manner.

4. The inflatable headboard assembly of claim 1, wherein the attaching member is configured to attach at the end of the headboard section.

5. The inflatable headboard assembly of claim 1, further comprising:

one or more straps attached to a posterior surface of the inflatable headboard assembly, where the one or more straps are configured to secure the inflatable headboard assembly to a headboard of a bed.

6. The inflatable headboard assembly of claim 1, wherein the headboard section includes an inflation valve configured to receive air from a user.

7. The inflatable headboard assembly of claim 1, wherein the support section includes an inflation valve configured to receive air from a user.

8. The inflatable headboard assembly of claim 1, wherein the attaching member includes an adjustable plane contoured to fit underneath the mattress, the adjustable plane capable of rotating 180 degrees about a fixed axis located at a base of the attaching member.

9. The inflatable headboard assembly of claim 1, wherein the inflatable headboard assembly includes a plurality of lights located within an interior wall of the headboard section, the plurality of lights configured to illuminate one or more portions of the headboard section.

10. The inflatable headboard system of claim 1, wherein an anterior surface of the inflatable headboard assembly includes one or more visual markers capable of receiving an augmented reality overlay when the one or more visual markers are detected by a client device.

11. A method for mounting an inflatable headboard assembly to a bed, the method comprising:

inflating a headboard section comprising a first inflatable bladder;

inflating a support section comprising a second inflatable bladder;

attaching an attaching member to the inflatable headboard assembly, the attaching member attached such that the headboard section extends from the attaching member in a first direction orthogonal to the attaching member and the support section extends from the attaching member in a second direction opposite the first direction, the attaching member having an adjustable plane contoured to fit underneath a mattress; and mounting the inflatable headboard assembly to a bed, wherein the mounting comprises wedging the adjustable plane between the mattress and an underlying support of the mattress.

12. The method of claim 11, further comprising:

adjusting an inflation of the support section such that a height of the attaching member corresponds to a height of the mattress.

13. The method of claim 11, wherein mounting the inflatable headboard assembly to the bed further comprises:

coupling the attaching member to a set of mounting pegs, wherein the attaching member includes a set of peg holes configured to couple the attaching member to the set of mounting pegs, the set of mounting pegs affixed to a anterior surface of the inflatable headboard assembly.

14. The method of claim 13, wherein the set of peg holes are coupled to the set of mounting pegs in a male-female coupling manner.

15. The method of claim 11, wherein the attaching member is attached at the end of the headboard section.

16. The method of claim 11, further comprising:

securing the inflatable headboard assembly to a headboard of a bed using one or more straps attached to a posterior surface of the inflatable headboard assembly.

17. The method of claim 16, wherein the one or more straps are attached to the posterior surface of the headboard section.

18. The method of claim 11, wherein inflating the headboard section comprises receiving air from a user via an inflation valve.

19. The method of claim 11, wherein inflating the support section comprises receiving air from a user via an inflation valve.

20. The method of claim 11, wherein the adjustable plane rotates 180 degrees about a fixed axis located at a base of the attaching member.

* * * * *